343-700 MS 851 2X
7/16/85 4,529,987

United States Patent [19]
Bhartia et al.
[11] Patent Number: 4,529,987
[45] Date of Patent: Jul. 16, 1985

343/700MS

[54] BROADBAND MICROSTRIP ANTENNAS WITH VARACTOR DIODES

[75] Inventors: Prakash Bhartia, Ottawa, Canada; Inder J. Bahl, Roanoke, Va.

[73] Assignee: Her Majesty the Queen in right of Canada, as represented by the Minister of National Defence of Her Majesty's Canadian Government, Ottawa, Canada

[21] Appl. No.: 487,439

[22] Filed: Apr. 21, 1983

[51] Int. Cl.[3] ..... H01Q 1/38
[52] U.S. Cl. ..... 343/700 MS; 343/745
[58] Field of Search ..... 343/700 MS, 829, 745, 343/830, 846; 333/219, 246, 238

[56] References Cited

U.S. PATENT DOCUMENTS

| | | | |
|---|---|---|---|
| 3,680,136 | 7/1972 | Collings | 343/700 MS |
| 4,053,895 | 10/1977 | Malagisi | 343/700 MS |
| 4,259,670 | 3/1981 | Schiavone | 343/700 MS |
| 4,475,108 | 10/1984 | Moser | 343/700 MS |

*Primary Examiner*—Eli Lieberman
*Assistant Examiner*—Michael C. Wimer
*Attorney, Agent, or Firm*—Anthony T. Lane; Jeremiah G. Murray; Maurice W. Ryan

[57] ABSTRACT

A microstrip antenna is disclosed consisting of a flat metallic patch spaced from the ground plane. To increase the bandwidth of the antenna a pair of varactor diodes are provided positioned at opposite sides of the patch and connected between it and the ground plane.

6 Claims, 2 Drawing Figures

BROADBAND MICROSTRIP ANTENNAS WITH VARACTOR DIODES

BACKGROUND OF THE INVENTION

This invention relates to microstrip antennas and, in particular, to such antennas having increased bandwidth.

Typical microstrip antennas consist of a flat metallic patch adjacent to a ground plane and separated therefrom by a thin dielectric substrate. Their thin construction makes them particularly useful as low-profile flush-mounted antennas on rockets and missiles since they neither disrupt aerodynamic flow nor protrude to interrupt the mechanical structure. They are also useful because of their low cost, reproductibility, design flexibility, ease of fabrication and installation and rugged design. Their unique features such as low profile, compatibility with the modular approach, ease of integration of feed lines and matching networks, and the possibility of obtaining either linear or circular polarization have made them ideal for many applications. The signal supplied to the patch may be by means of a feed conductor in the plane of the patch or a coaxial connection to an interior point on the patch. Such antennas suffer from the disadvantage of an extremely narrow bandwidth of the order of one or two percent at V.H.F.-U.H.F. frequencies and two to five percent at S.H.F. and E.H.F. frequencies.

It is known to increase the bandwidth of microstrip antennas by placing conductive strips acting as parasitic elements parallel to and spaced from the non-radiating edge of a rectangular patch or by placing shorted quarter wave-length strips parallel to and spaced from the radiating edges of such patches. This has the disadvantages of requiring significant modification to the original antenna element making it virtually impossible to use the element in an array configuration. The size of the antenna is also increased, which is also undesirable.

An alternative known manner of increasing the bandwidth of microstrip antennas is to use a linear array of patch resonators whose size and spacing increase in a log-periodic manner. At any given frequency only a few of the resonators are excited and radiate forming an active region which moves along the array as the frequency is changed.

SUMMARY OF THE INVENTION

The present invention achieves the goal of a microstrip antenna with increased bandwidth by providing a pair of varactor diodes on either side of the patch coupled between it and ground. Specifically, the invention is used in a microstrip antenna having a flat metallic patch spaced from a ground plane. The invention relates to the improvement comprising a pair of varactor diodes connected between the patch and the ground plane and positioned at opposite sides of the patch whereby the bandwidth of the antenna is increased.

The improvement in bandwidth results from the fact that the electrical length of a transmission line loaded periodically with reactive components is increased or decreased depending upon the type of reactance used. The present invention introduces this reactance by the use of voltage controlled tuning varactor diodes introduced at the radiating edges of the antenna. Thus, varying the reverse bias d.c. voltage of the varactors, varies the capacitance introduced by the varactors and hence changes the resonant frequency of the antenna. Thus, the operational frequency of the antenna can be increased and bandwidth of the order of thirty percent have been achieved.

BRIEF DESCRIPTION OF THE DRAWINGS

The invention will be described in greater detail with reference to the accompanying drawings in which.

DETAILED DESCRIPTION OF A PREFERRED EMBODIMENT

Figure 1:
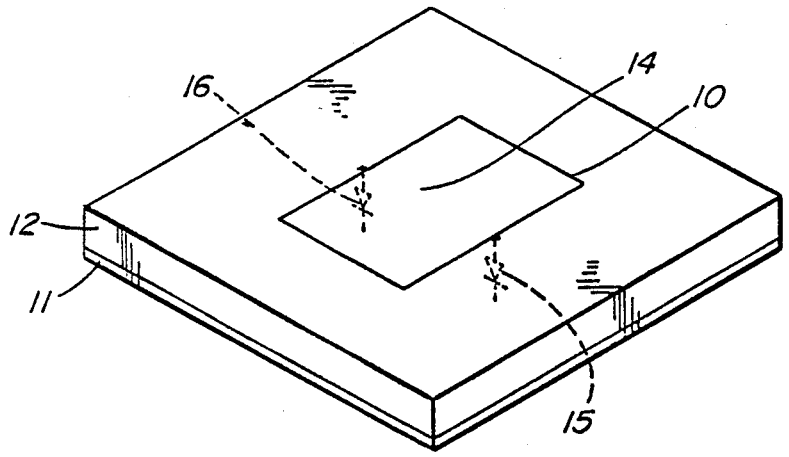
FIG. 1 shows a microstrip antenna having a rectangular patch.

FIG. 1 shows a microstrip antenna in accordance with the present invention. The radiating element is rectangular patch 10 separated from ground plane 11 by a thin dielectric layer 12. The antenna feed is applied via a coaxial cable to point 14. In accordance with the present invention the bandwidth of the antenna is increased by the provision of a pair of varactor diodes 15 and 16 connected between the edges of patch 10 and the ground plane.

Figure 2:
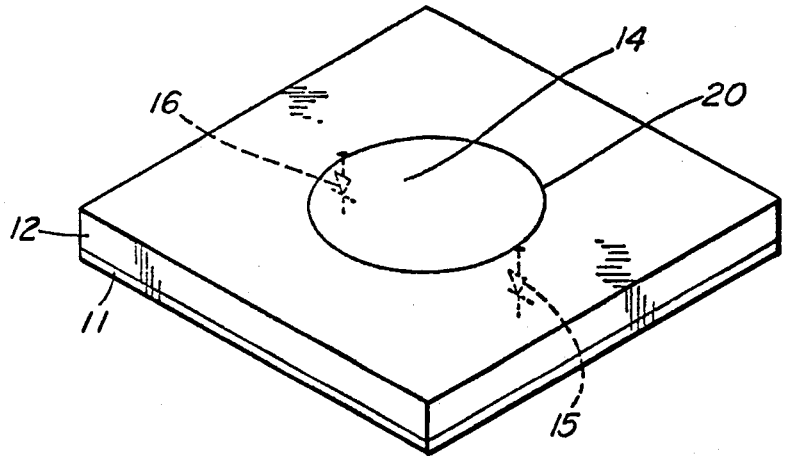
FIG. 2 shows a microstrip antenna using a circular disc.

FIG. 2 shows another embodiment in which similar elements bear the same reference numerals. In this embodiment the radiating element is a flat circular disc 20.

Thus there has been described the use of tuning varactors to improve the bandwidth characteristic of the antenna. There is no change in the size of the antenna, the inclusion of the varactors only requires the drilling of small holes at the radiating edge. Bandwidth improvements are significant and the technique can be applied to any antenna configuration. The disadvantage of using the modified structure in an array configuration as is prevalent with the other schemes is obviated. The design is valid for the rectangular, square, triangular, circular, pentagonal and other microstrip configurations.

The biasing of the antenna is achieved by a "bias-T" arrangement inserted in the signal line to the antenna and, thus, external to the antenna.

While the invention has been described in connection with illustrative embodiments, obvious variations thereof will occur to those skilled in the art, accordingly, the invention should be limited only by the scope of the appended claims.

What is claimed is:

1. A microstrip antenna comprising in combination:

a ground plane element;

antenna radiating patch means positioned and spaced a small fraction of the antenna operating wavelength from said ground plane element;

a dielectric layer disposed between and separating said ground plane element and said antenna radiating patch means; and at least two spatially opposed varactor diodes disposed interiorly of said dielectric layer, and each electrically connected between the ground plane element and the antenna radiating patch means.

2. An antenna as set forth in claim 1 wherein said antenna radiating means comprises a flat metallic patch.

3. An antenna as set forth in claim 2 wherein said varactor diodes are connected to opposing edges of said metallic patch.

4. A microstrip antenna comprising:

a ground plane;

a flat metallic patch positioned adjacent said ground plane and separated therefrom;

a plurality of varactor diodes connected between said ground plane and said patch and positioned at opposite edges of said patch.

5. A microstrip antenna as set forth in claim 4 wherein said patch is of rectangular configuration.

6. A microstrip antenna as set forth in claim 4 wherein said patch is a circular disc.

* * * * *